US005206970A

United States Patent [19]

Johnson

[11] Patent Number: 5,206,970

[45] Date of Patent: May 4, 1993

[54] ON-SITE PORTABLE STENCIL CLEANER

[75] Inventor: Jay R. Johnson, Chalfont, Pa.

[73] Assignee: EMC Global Technologies, Inc., Doylestown, Pa.

[21] Appl. No.: 881,188

[22] Filed: May 11, 1992

[51] Int. Cl.[5] ..... A47L 7/00

[52] U.S. Cl. ..... 15/321; 15/322; 15/345; 68/240; 101/425

[58] Field of Search ..... 15/302, 320, 321, 322, 15/345, 346; 220/571; 68/18 R, 200, 240, 205 R; 101/423, 424, 425

[56] References Cited

U.S. PATENT DOCUMENTS

| | | | |
|---|---|---|---|
| 2,009,365 | 7/1935 | Wait | 68/240 X |
| 2,444,728 | 7/1948 | Castoe | 68/240 X |
| 2,657,566 | 11/1953 | Richterkessing | 15/302 X |
| 2,881,463 | 4/1959 | Vogel | 15/302 |
| 3,134,127 | 5/1964 | Klein | 15/345 X |
| 3,775,053 | 11/1973 | Wisdom | 15/302 X |
| 3,874,022 | 4/1975 | Wogoman et al. | 15/321 |
| 4,808,237 | 2/1989 | McCormick et al. | 101/425 X |
| 4,817,646 | 4/1989 | Brooks | 15/302 X |
| 4,826,539 | 5/1989 | Harpold | 15/302 X |
| 4,961,244 | 10/1990 | Stanfield et al. | 15/302 X |
| 5,074,132 | 12/1991 | Koller | 15/322 X |
| 5,134,748 | 8/1992 | Lynn | 15/321 |

FOREIGN PATENT DOCUMENTS

| | | | |
|---|---|---|---|
| 0204655 | 12/1986 | European Pat. Off. | 101/425 |
| 0152156 | 8/1988 | European Pat. Off. | 101/425 |
| 2495059 | 6/1982 | France | 101/425 |
| 102030 | 7/1941 | Sweden | 68/205 R |
| 895125 | 5/1962 | United Kingdom | 101/425 |

*Primary Examiner*—Stephen F. Gerrity
*Attorney, Agent, or Firm*—Gregory J. Gore

[57] ABSTRACT

A two-part, hand-held portable cleaning system provides the ability for washing and vacuum cleaning printing stencil screens and the like in-situ in an environmentally safe manner. The system includes a vacuum-assisted drip pan and an applicator brush with a specially designed low-pressure, solvent-dispensing nozzle. The drip pan is held beneath the stencil or screen while the applicator brush floods the area to be cleaned with solvent, thus dislodging the accumulated printing medium by the mechanical action of the brush. Much of the contaminated solvent flows through the stencil or screen into the drip pan below. Vacuum hoses attached to both the drip pan and the applicator brush remove the liquid solvent and any solvent vapor in the vicinity. A separation chamber is located in the air vacuum circuit between the blower and the hoses and is positioned above the reservoir connected thereto by a gravity-feed drain line. A charcoal filter in the air circuit is located between the blower and the separation chamber to reduce pollutants in the exhausted air.

7 Claims, 5 Drawing Sheets

ON-SITE PORTABLE STENCIL CLEANER

FIELD OF THE INVENTION

The present invention relates to a method and structures for cleaning printing screens, stencils, misprinted printed wiring boards (PCB's), and other substrates. This invention is in the field of hand-held cleaning and vacuum systems which employ a volatile solvent.

BACKGROUND OF THE INVENTION AND BRIEF DESCRIPTION OF THE PRIOR ART

Stencils and other printing screens more commonly known as silk screens are in a well-established art. These screens are widely used in the visual arts for printing, but they also are used in a field of semi-conductor manufacture. In one such field, stencils are used to print alternating resist layers in producing ceramic hybrid circuits.

This type of printing in the semiconductor manufacturing industry must be carried out at extremely close tolerances. In order to maintain the accuracy and quality of the printing, the stencils must be cleaned regularly. This presents particular problems, since the stencils are difficult to remove from the printing machine. Furthermore, they need adjustment once they are reinstalled in order to ensure that accurate registration with the printed substrate has been re-established. This process of removing, cleaning and reinstalling the stencil is therefore extremely time-consuming.

Another problem of cleaning semiconductor stencils is that volatile and often hazardous chemicals are used for solvents which dissolve and carry off the excess material on the used stencils. This requires extremely specialized cleaning equipment so that the solvent may be introduced to the stencil, and thereafter that the used contaminated solvents be removed from the cleaning area with a minimal amount of air contamination due to solvent evaporation.

Systems for cleaning print screens which are pertinent to the dual use of vacuum and a liquid spray include U.S. Pat. No. 4,808,237 issued to McCormick et al, and U.S. Pat. No. 4,826,539 issued to Charles W. Harpold. These patents represent the closest prior art of which the applicant is aware. The patent to McCormick et al represents a high-pressure hot water system without vacuum assist. The patent to Harpold shows the use of a vacuum in combination with a solvent spray; however, with this device, the screen must first be removed from the printing machine before cleaning. Also, the Harpold air handling and solvent plumbing operate in a manner which is environmentally unsound because the exhaust air is unfiltered and the blower draws a vacuum directly upon the liquid reservoir. Furthermore, the spray pressure is too great to minimize evaporation. Therefore, while pertinent, neither of these references anticipates or suggests the applicant's invention, nor are these devices capable of its results.

SUMMARY OF THE INVENTION

In order to fulfill the unsatisfied needs in the art described above, the applicant has devised a portable cleaning system which has shown to be environmentally safe and provides the added convenience of stencil cleaning in-situ; that is, while the stencil is still fixed in its operating position on the printing machine. This is accomplished by a two-piece, hand-held system including a vacuum-assisted drip pan and an applicator brush with a specially designed low-pressure, solvent-dispensing nozzle. In operation, the cleaner is first brought to the printer. The drip pan is then held beneath the stencil while the applicator brush floods the stencil with solvent and dislodges the accumulated printing medium by the mechanical action of the brush. Much of the contaminated solvent flows through the stencil into the drip pan below. Vacuum hoses attached to both the drip pan and the applicator brush remove both the liquid solvent and any solvent vapor in the vicinity of the stencil.

Because the solvent is delivered at very low pressure to the cleaning brush, there is little chance of spray atomization of the solvent and, therefore, solvent evaporation and air pollution during the cleaning process is minimized. The low evaporation application of the solvent to the stencil is aided by a defuser screen within the cleaning brush which distributes the solvent by gravity drip, rather than by pressure spray. The solvent is delivered to the brush head under minimal pressure that is just sufficient to raise the solvent fluid from the lower level of the reservoir through the supply hose to the height of the stencil.

Reclamation of solvent which is contaminated with stencil residue is accomplished by a high volume air flow which is created by drawing a vacuum, both through a hose connected to the cleaning brush and a second air hose connected to the hand-held drip pan. Used solvent is carried by the air flow back to a solvent reservoir. As will be more fully described in the preferred embodiment, the air flow is handled in an extremely environmentally-safe manner because it is extensively filtered before being exhausted into the atmosphere. Also, the liquid solvent is returned to the reservoir by a gradual gravity flow without a vacuum being drawn directly on the reservoir so that evaporation of reservoir solvent is mitigated.

More specifically, the applicant has devised a vacuum-assisted cleaner for the stencil of a printing machine, comprising: a cleaning wand having a brush head and a first vacuum air hose and a brush head; a solvent supply hose connected to the cleaning brush head; a blower for drawing a vacuum on the brush head through the first vacuum air hose capturing air in the vicinity of the brush head; a second vacuum air hose connected to said blower; and a hand-held drip pan having a handle and a plurality of fluid and air duct means connected to the second vacuum air hose, whereby the drip pan is hand-held underneath the stencil mounted in the printing machine as the stencil is cleaned by the solvent and mechanical cleaning action of the brush head and used solvent is collected in the pan and returned to the solvent reservoir through the second vacuum air hose.

A solvent defuser screen is affixed to the inside of the brush head and located across the end of the solvent supply hose. A low pressure pump is connected between the solvent reservoir and the solvent supply hose for delivering solvent to the brush head without a forcible spray. A separation chamber is located in the air circuit between the blower and the first and second vacuum hoses. The chamber is located above the reservoir and incorporates a gravity-feed liquid drain line which is connected to the reservoir, the reservoir being enclosed at atmospheric pressure. Thus, solvent droplets and vapors in the air from the vacuum hoses passing through the chamber are separated from the air and returned by gravity to the reservoir. A charcoal filter in the air circuit is located between the blower and the separation chamber.

It is therefore an object of the present invention to provide an environmentally safe stencil cleaning device which is capable of applying a solvent to a printing stencil and reclaiming the solvent and stencil residue with a minimum amount of solvent evaporation into the atmosphere.

It is a further object of the present invention to create a labor-saving stencil cleaning system which permits the cleaning of a printing stencil in-situ on the printing machine. These and other objects and advantages of the present invention will become apparent to one of ordinary skill in the art from the following drawings and description of the preferred embodiment.

DESCRIPTION OF THE PREFERRED EMBODIMENT

Figure 1:
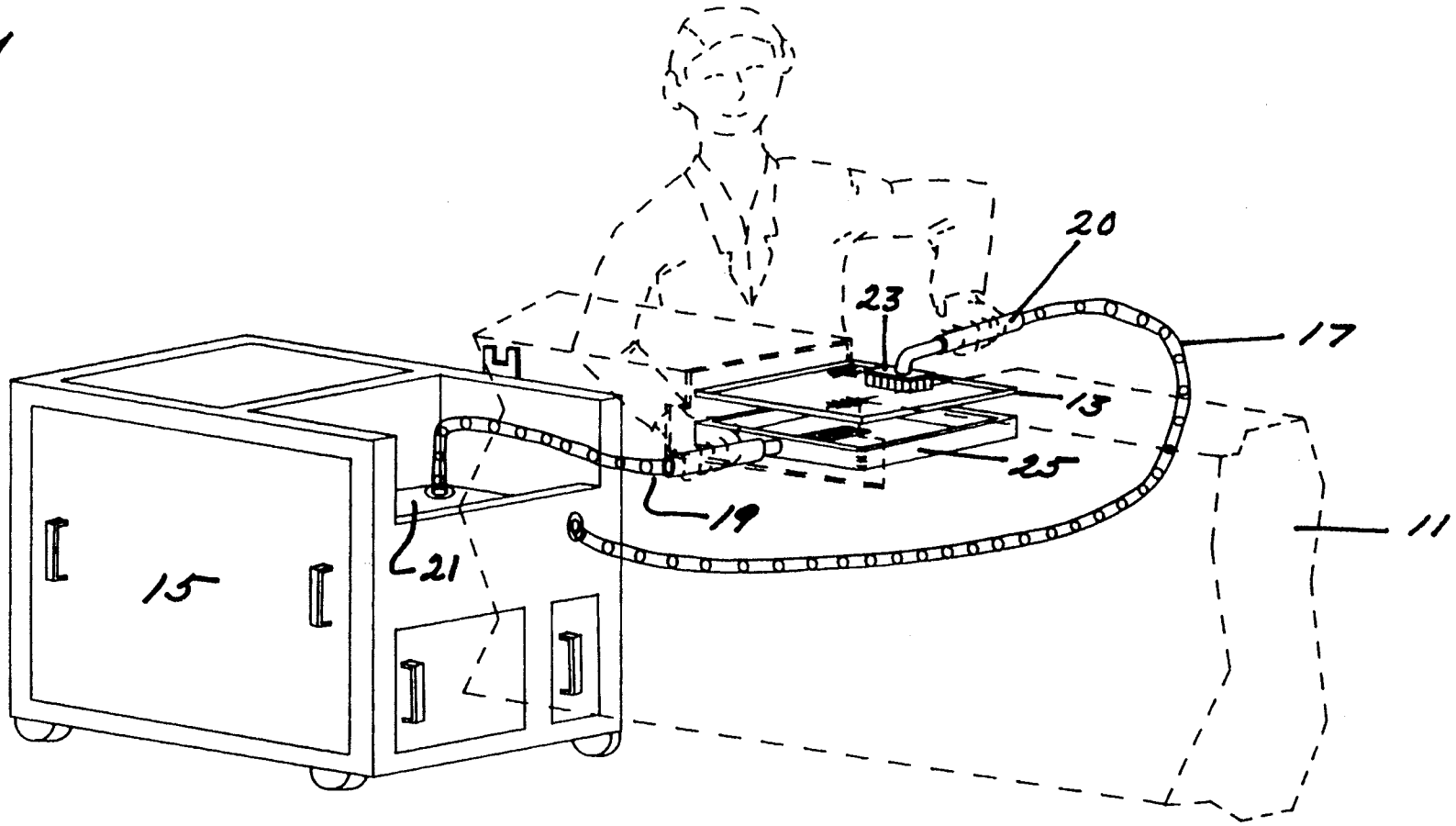
FIG. 1 is a top, right front perspective view of the present invention being used by an operator on a hypothetical printing machine; both the operator and the printing machine are shown in phantom lines.

Referring now to FIG. 1, the present screen cleaning invention is shown in use. Printing machine 11 which is shown in phantom lines holds a stencil element 13 which remains fixed in the machine during the cleaning process. The major mechanical components of the cleaner are held within wheeled cabinet 15 which is moved to the site of the printing machine. As the stencil is cleaned, the cleaning wand 20 with brush head 23 and vacuum hose 17 is moved across the top of the stencil as drip pan 25 is held underneath the screen. The drip pan is connected to the cleaner by vacuum hose 19. Vacuum hose 19 is connectable to the drain of sink 21 within the top right side of the cleaner cabinet.

Figure 2:
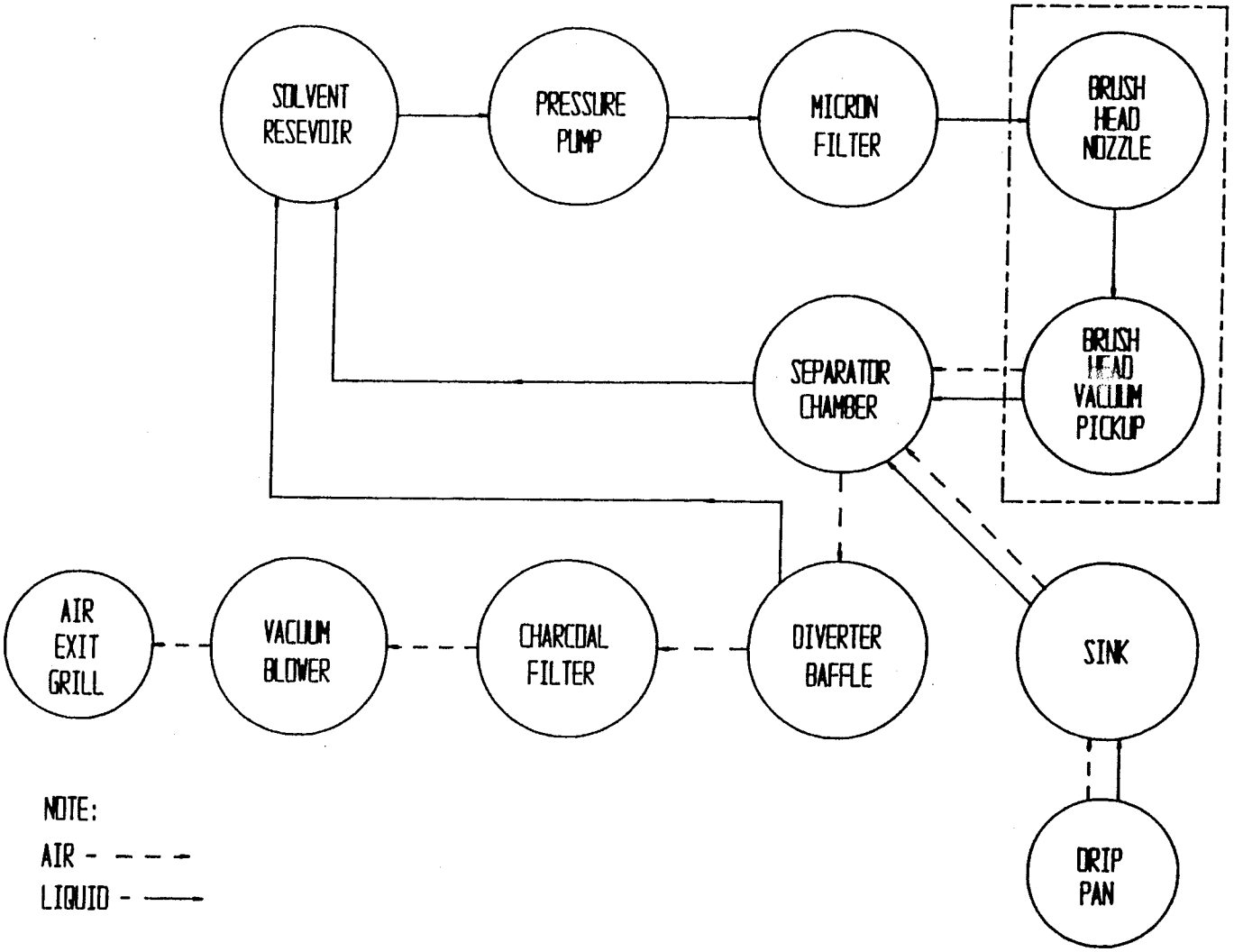
FIG. 2 is a flow diagram showing the air and liquid circuits of the present invention.

FIG. 2 is a flow diagram of both the air and liquid solvent circuits. The air circuit is shown in dotted lines and the liquid circuit in solid lines. The arrows indicate the direction of flow. The pressure pump is preferably a low-pressure metering pump which creates pressure just sufficient to raise the liquid solvent from the lower level of the reservoir to the higher level of the cleaning brush. A sub-micron filter is in the solvent circuit between the pump and the brush wand nozzle. The brush head shown in dotted lines contains both the liquid nozzle and a vacuum pickup. The vacuum pickup draws both contaminated air and used liquid solvent from the vicinity of the brush head. The air is drawn through the vacuum hose by vacuum blower. Separator tank resides in the air circuit between the brush head and the vacuum blower. Charcoal filter is positioned directly upstream of the vacuum blower and functions as a final filter of all vacuum air to remove contaminants that might not have been removed in the separator chamber or diverter baffle. As apparent from this diagram, no vacuum is drawn directly on the liquid reservoir. This is an important feature of this invention which minimizes solvent evaporation from the reservoir which reduces the amount of solvent contaminants in the vacuum blower exhaust.

Figure 3:
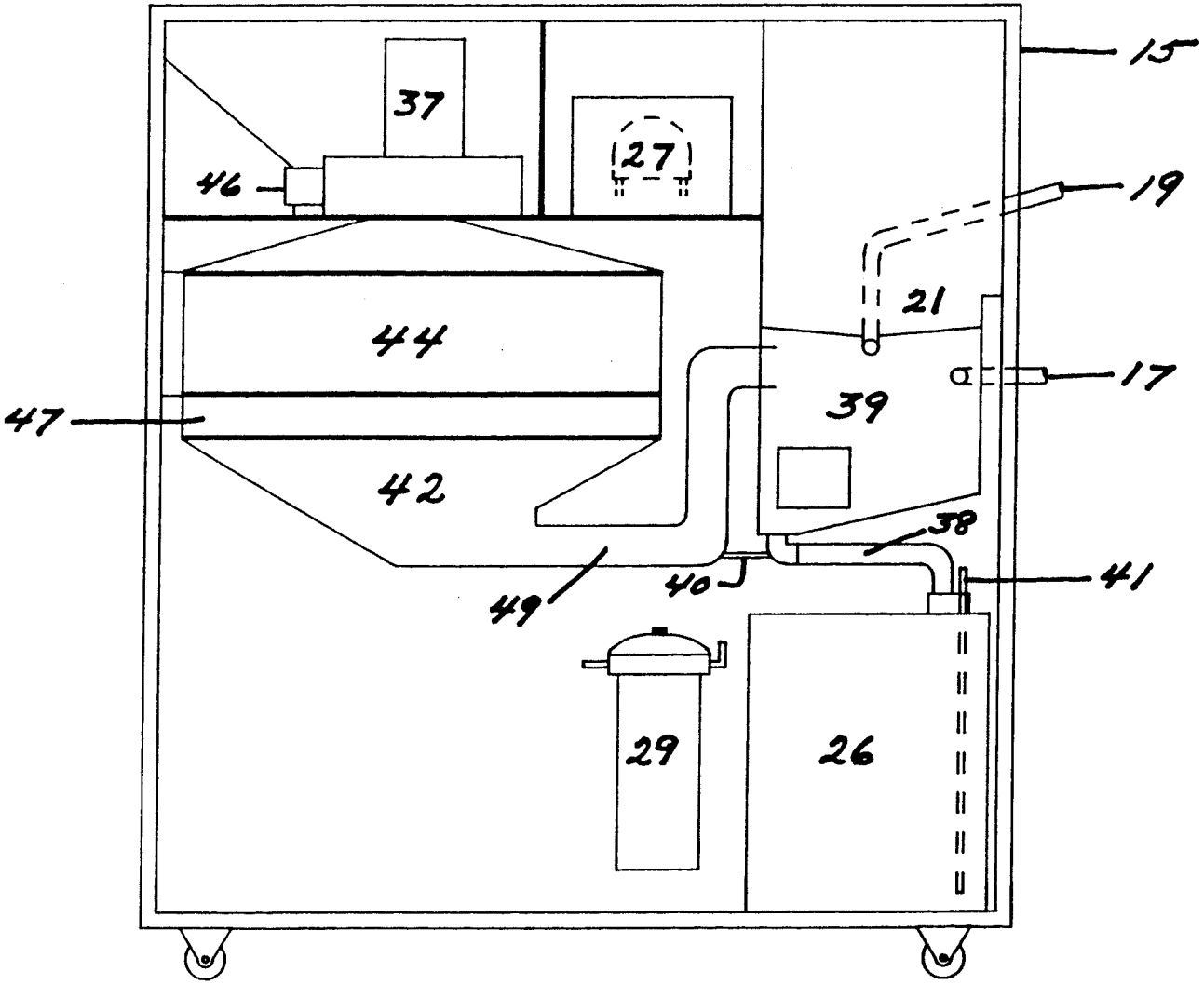
FIG. 3 is a front sectional view of the present invention taken from FIG. 1 as shown in that figure.

Referring now to FIG. 3, the major mechanical components of the present invention within cabinet 15 are shown. Separator chamber 39 lies directly above reservoir 26 so that solvent liquid separated in the chamber returns to the reservoir by gravity through line 38. Line 40 serves the same purpose for returning liquid separated by diverter baffle 47. Solvent is forced from the reservoir by a low pressure pump 27. This pump is of the type sold by Cole-Parmar Instrument Company, Chicago, Illinois, as Adjustable Diphragm Liquid Pump, Model No. L-7131-90. When using volatile solvents, this pump is operated at approximately 3.0 psi. The pump delivers solvent through filter 29 to a liquid line that is incorporated with a first vacuum hose which is connected to the hand-held wand and brush. Vacuum pickup line 17 is connected to the wand and delivers air and solvent to the separation chamber 39. Vacuum hose 19 is connected to the drain hole at the bottom of the sink 21 and carries air and solvent from the drip pan likewise to the separation chamber. Many different solvents may be used and the supply pressure increased for non-volatile or non-hazardous solvents, such as water.

Blower 37 pulls air through the charcoal filter chamber 44 and exhausts the air through outlet 46. The diverter baffle 47 located just upstream of the charcoal filter chamber spreads the flow of air evenly across the surface of the filter bed 44. The filter is constructed of a simple screen bed which holds evenly distributed, granular, activated carbon. Filters of this type are available commercially from a variety of sources. Baffles in the separator tank capture airborne solvent which then drain by gravity through line 38 back to solvent reservoir 26. Hose 49 interconnects the filter chamber with the separation chamber 39. Small drip line 40 is located at a low-lying elbow of the hose and directs any accumulated solvent to gravity feed line 38 which returns the solvent to the reservoir 26. Hence, the diverter baffle operates to further separate any airborne solvent which is similarly returned to the liquid reservoir through gravity drip line 40. The reservoir includes vent 41 to ensure that the reservoir enclosure remains at atmospheric pressure. Also, line 38 leading to the reservoir is of a small diameter such that no substantial vacuum is drawn upon the reservoir enclosure.

Contaminated cleaning solvent is also returned to the reservoir by the hand-held drip pan which is connected to a drain pipe in sink 21 through a second vacuum hose 19. This vacuum hose carries both air and solvent vapors to separator chamber 39 and is processed in the same way as the solvent and air vacuum pickup from the brush head described above.

Figure 4:
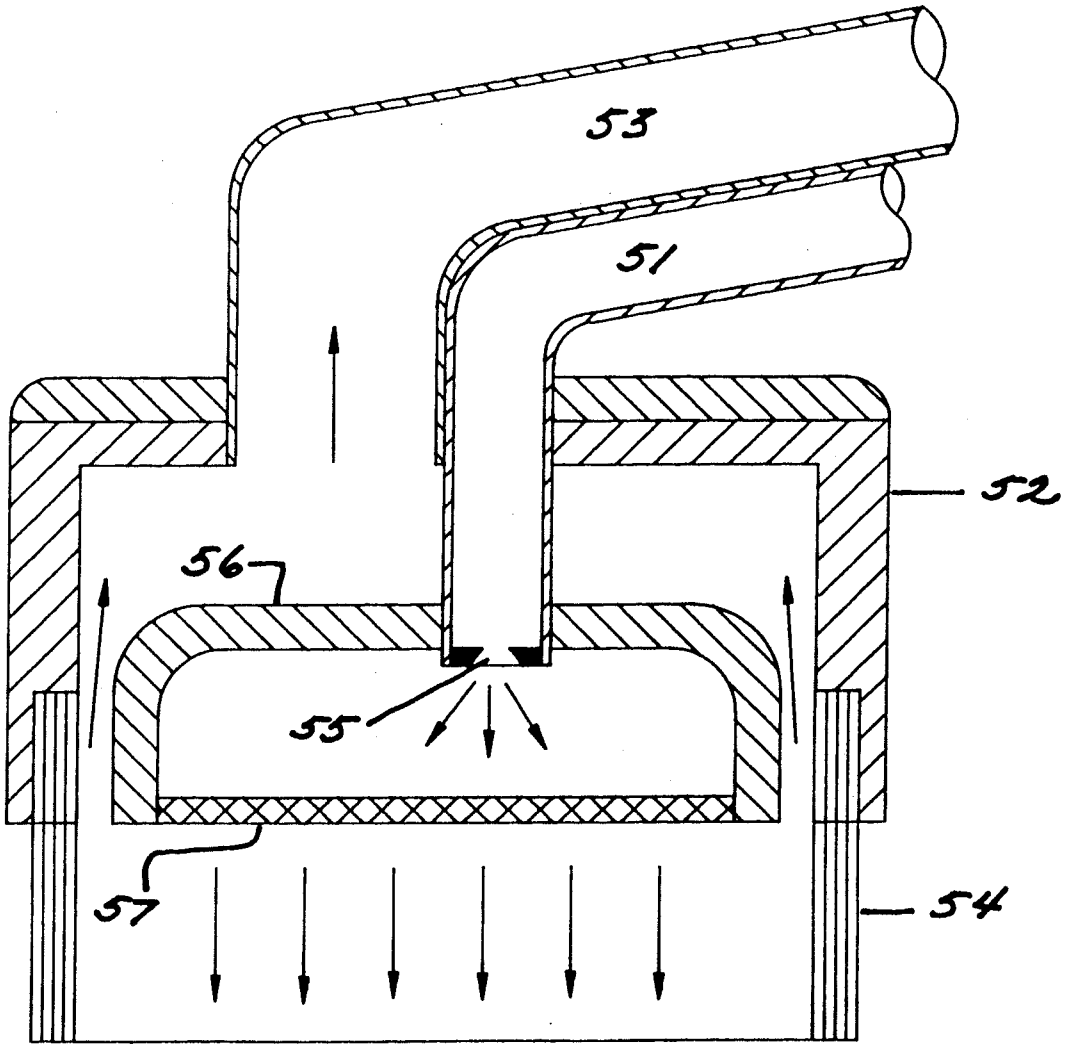
FIG. 4 is a side-sectional view of the cleaning brush taken from FIG. 1 as shown in that figure.

Referring to FIG. 4, greater detail of the brush head is shown. The brush head is fixed to the end of a hand-held wand which includes two lines, a solvent supply hose 51 and a vacuum pickup line 53. The brush head includes body 52 which supports the vacuum and solvent hoses, as well as brushing bristles 54. Solvent delivered to the brush head passes through nozzle 55 and defuser screen 57 mounted in defuser head 56. The screen ensures that the solvent is delivered down from the center of the brush head in an even gravity drip without any forcible spray pressure. This helps mitigate solvent evaporation.

Figure 5:
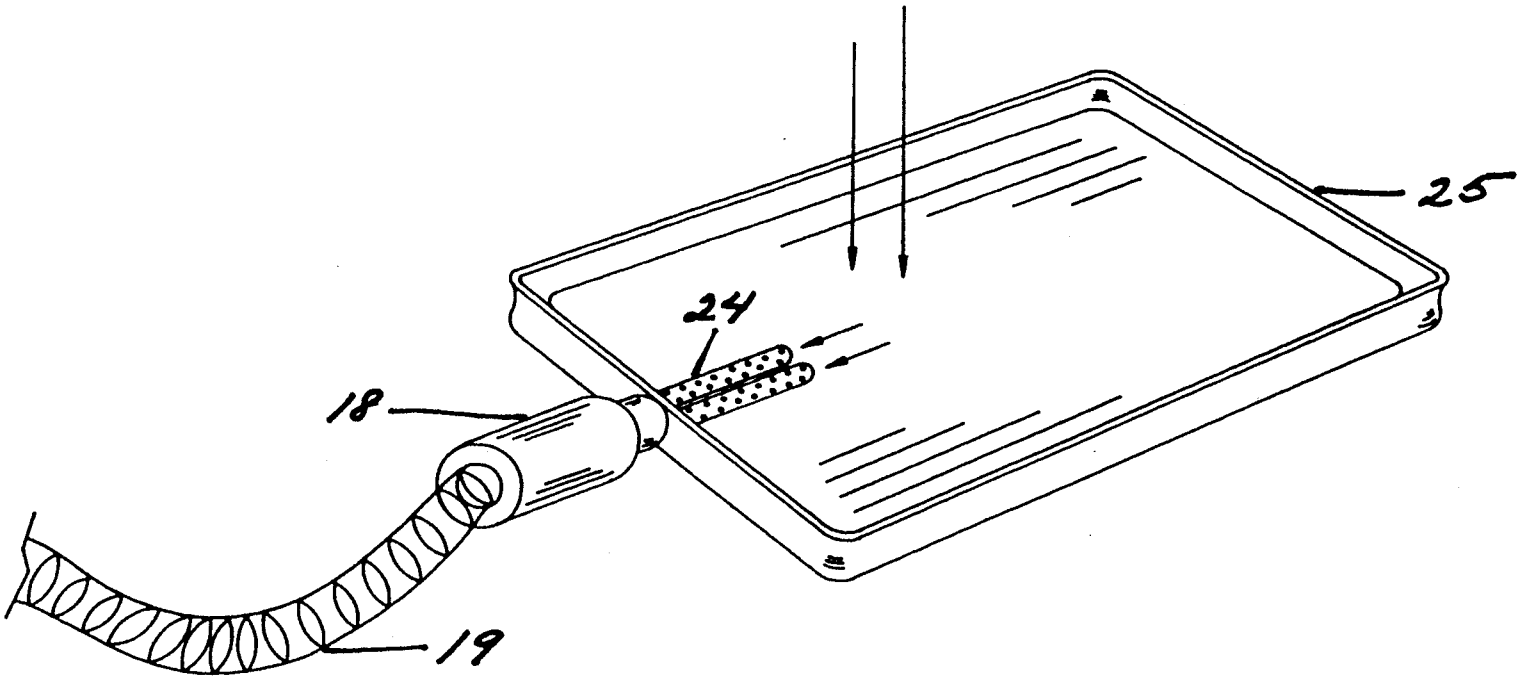
FIG. 5 is a top, right front perspective view of the hand-held drip pan.

Referring now to FIG. 5, drip pan 25 includes a plurality of air and solvent intake ducts 24 at a low lying portion of the bottom of the pan. Handle 18 supports the pan and vacuum hose 19 returns air and solvent to the separation chamber within the cleaner cabinet. Arrows shown in this figure depict vapor and solvent which falls from the stencil during cleaning. In situations where non-hazardous solvent is used, the drip pan and vacuum hose 19 may be disconnected from the sink drain and the stencil may be removed from the machine and cleaned in the sink area as desired.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

I claim:

1. A vacuum-assisted cleaner for the stencil of a printing machine, comprising:

a hand-held cleaning wand having a brush head and a first vacuum air hose terminating within the brush head;

a solvent reservoir with a solvent supply hose connected to said cleaning brush head;

a blower connected to the first air hose for drawing a vacuum on said brush head through said first vacuum air hose for capturing air and solvent in the vicinity of said brush head;

a second vacuum air hose connected to said blower; and a hand-held drip pan having a handle and a plurality of fluid and air duct means connected to said second vacuum air hose, whereby said drip pan is held underneath the stencil mounted in said printing machine as said stencil is cleaned by the solvent and mechanical cleaning action of said brush head as said brush head is manually manipulated on the stencil and used solvent is collected in said pan through the second vacuum air hose.

2. The stencil cleaner of claim 1, further including a solvent defuser screen affixed to the inside of the brush head and located across the end of the solvent supply hose.

3. The stencil cleaner of claim 2, further including a low pressure pump connected between said solvent reservoir and the solvent supply hose for delivering solvent to said brush head without a forcible spray.

4. The stencil cleaner of claim 3, wherein the first and second vacuum air hoses are connected to said blower through an air circuit and further including a separation chamber located in the air circuit between the blower and the first and second vacuum hoses, said chamber located above said reservoir and having a gravity-feed liquid drain line connected to said reservoir whereby solvent in the air from said vacuum hoses passing through said chamber is separated from the air and returned by gravity to the reservoir.

5. The stencil cleaner of claim 4, further including a charcoal filter in the air circuit located between the blower and said separation chamber.

6. The stencil cleaner of claim 5, further wherein said reservoir is enclosed at atmospheric pressure.

7. The stencil cleaner of claim 6, further wherein the stencil remains fixed in the printing machine during cleaning.

* * * * *